US011600955B2

(12) United States Patent
Ohni et al.

(10) Patent No.: US 11,600,955 B2
(45) Date of Patent: Mar. 7, 2023

(54) PLUG-IN CONNECTOR AND METHOD

(71) Applicant: MD ELEKTRONIK GmbH, Waldkraiburg (DE)

(72) Inventors: Josef Ohni, Kraiburg am Inn (DE); Thomas Halbig, Dietfurt (DE); Thomas Grasser, Gars am Inn (DE)

(73) Assignee: MD ELEKTRONIK GMBH, Waldkraiburg (DE)

( * ) Notice: Subject to any disclaimer, the term of this patent is extended or adjusted under 35 U.S.C. 154(b) by 5 days.

(21) Appl. No.: 17/471,208

(22) Filed: Sep. 10, 2021

(65) Prior Publication Data

US 2022/0094114 A1 Mar. 24, 2022

(30) Foreign Application Priority Data

Sep. 24, 2020 (DE) ..... 10 2020 124 893.8

(51) Int. Cl.

| | |
|---|---|
| ***H01R 13/658*** | (2011.01) |
| ***H01R 13/6586*** | (2011.01) |
| ***H01R 13/6588*** | (2011.01) |
| ***H01R 13/6598*** | (2011.01) |
| *H01R 107/00* | (2006.01) |
| *H01R 103/00* | (2006.01) |

(52) U.S. Cl.

CPC ..... *H01R 13/6586* (2013.01); *H01R 13/6588* (2013.01); *H01R 13/6598* (2013.01); *H01R 2103/00* (2013.01); *H01R 2107/00* (2013.01)

(58) Field of Classification Search

CPC ..... H01R 13/6586; H01R 13/6588; H01R 13/6598; H01R 103/00

USPC ..... 439/607.05

See application file for complete search history.

(56) References Cited

U.S. PATENT DOCUMENTS

| | | | | |
|---|---|---|---|---|
| 5,425,661 | A * | 6/1995 | Self, Jr | H01R 13/432 439/748 |
| 10,063,008 | B2 * | 8/2018 | Kawai | H01R 13/6683 |
| 10,103,500 | B2 | 10/2018 | Zebhauser et al. | |
| 10,153,598 | B2 * | 12/2018 | Watanabe | H01C 1/01 |

(Continued)

FOREIGN PATENT DOCUMENTS

| | | |
|---|---|---|
| DE | 2806496 A1 | 8/1978 |
| DE | 8707518 U1 | 8/1987 |

(Continued)

*Primary Examiner* — Alexander Gilman

(74) *Attorney, Agent, or Firm* — Leydig, Voit & Mayer, Ltd.

(57) ABSTRACT

A plug-in connector for a two- or multi-wire cable includes a male and female contact. The male and female contacts are configured to be coupled to first and second wires, respectively, and are elongated in a plug-in direction. A carrier element is configured to position and receive the male and female contacts in first and second receiving spaces, respectively, each at a predefined angle with respect to the plug-in direction, and to electrically insulate the male and female contacts from one another. A shielding element includes first and second channels for receiving the first and second wires, respectively. The channels each penetrate the shielding element from its end located counter to the plug-in direction to its end located in the plug-in direction. The shielding element comprises an electrically conducting material, and is arranged at an end of the carrier element located counter to the plug-in direction.

19 Claims, 9 Drawing Sheets

(56) References Cited

U.S. PATENT DOCUMENTS

| | | | | |
|---|---|---|---|---|
| 10,224,678 | B2 * | 3/2019 | Chen | H01R 43/24 |
| 10,355,391 | B2 * | 7/2019 | Uenosono | H01R 13/5025 |
| 10,389,056 | B2 * | 8/2019 | Suzuki | H01R 13/426 |
| 10,468,836 | B2 * | 11/2019 | Huber | H01R 13/6608 |
| 10,700,463 | B2 * | 6/2020 | Yanagihashi | H01R 13/506 |
| 2005/0133245 | A1 * | 6/2005 | Katsuyama | H01R 13/719<br>174/75 C |
| 2009/0262968 | A1 * | 10/2009 | Akino | H01R 13/6585<br>29/857 |
| 2013/0217277 | A1 * | 8/2013 | Friese | H01R 13/4367<br>439/733.1 |
| 2014/0073189 | A1 * | 3/2014 | Kondou | H01R 24/30<br>439/620.21 |
| 2016/0126681 | A1 * | 5/2016 | Kawai | H01R 13/6683<br>439/620.21 |
| 2018/0145431 | A1 * | 5/2018 | Huber | H01R 13/6589 |
| 2018/0145465 | A1 * | 5/2018 | Huber | H01R 24/30 |
| 2019/0260166 | A1 * | 8/2019 | Droesbeke | H01R 43/20 |
| 2021/0057853 | A1 * | 2/2021 | Droesbeke | H01R 9/0518 |
| 2021/0057854 | A1 * | 2/2021 | Droesbeke | H01R 13/6593 |
| 2021/0066856 | A1 * | 3/2021 | Droesbeke | H01R 13/646 |
| 2021/0066858 | A1 * | 3/2021 | Bergner | H01R 43/24 |
| 2021/0119376 | A1 * | 4/2021 | Nakano | H01R 13/5202 |
| 2021/0281023 | A1 * | 9/2021 | Wiebe | H01R 24/44 |

FOREIGN PATENT DOCUMENTS

| | | | |
|---|---|---|---|
| DE | 102010000515 | A1 | 8/2011 |
| EP | 3319182 | A1 | 5/2018 |

* cited by examiner

PLUG-IN CONNECTOR AND METHOD

CROSS REFERENCE TO RELATED APPLICATIONS

This application claims benefit to German Patent Application No. DE 10 2020 124 893.8, filed on Sep. 24, 2020, which is hereby incorporated by reference herein.

FIELD

The invention relates to a plug-in connector for a two-wire or multi-wire cable, that is to say for a cable with at least two wires, in particular a cable with at least one wire pair for differential data transmission, in particular a twisted pair cable. The invention furthermore relates to a corresponding method for assembling such a cable having such a plug-in connector.

The present invention is mainly described with reference to twisted pair cables for data transmission. It shall be understood that the present invention can nevertheless be used with any type of two-wire cables.

BACKGROUND

In modern technical applications, such as in vehicles, a plurality of electrical units are usually installed today. Such electronic units assist the driver with driving the vehicle or completely take over guidance of the vehicle from the driver, at least in certain situations.

The provision of such functions in a vehicle presupposes that a plurality of sensor data can be processed, and different vehicle systems can communicate effectively with one another. The necessary data rates in the Gbit range require efficient and high-quality cabling in the vehicle, which enables communication with the lowest possible error rates.

In particular, in the case of such onboard vehicle electrical systems, the plug-in connectors usually constitute high-frequency imperfections, which are, however, to be avoided.

SUMMARY

In an embodiment, the present disclosure provides a plug-in connector for a two-wire or multi-wire cable comprising at least one wire pair for a differential data transmission, comprising a first wire and a second wire which is arranged in the cable next to the first wire. A male contact is configured to be coupled to the first wire and is elongated at least in a plug-in direction of the plug-in connector. A female contact is configured to be coupled to the second wire and is elongated at least in the plug-in direction of the plug-in connector. The female contact is configured to receive a male contact of a further plug-in connector, and the male contact is configured to receive a female contact of the further connector. A carrier element is configured to position and receive the male contact in a first receiving space and the female contact in a second receiving space, each at a predefined angle with respect to the plug-in direction of the plug-in connector, and to electrically insulate the male contact and the female contact from one another. A shielding element includes a first channel for receiving the first wire and a second channel for receiving the second wire, wherein the first channel and the second channel each penetrate the shielding element from an end of the shielding element located counter to the plug-in direction to an end of the shielding element located in the plug-in direction. The shielding element comprises an electrically conducting material, and is arranged at an end of the carrier element located counter to the plug-in direction.

BRIEF DESCRIPTION OF THE DRAWINGS

Subject matter of the present disclosure will be described in even greater detail below based on the exemplary figures. All features described and/or illustrated herein can be used alone or combined in different combinations. The figures are merely schematic representations and serve only to explain exemplary embodiments of the present invention. Identical or identically acting elements are denoted by the same reference numbers throughout. The features and advantages of various embodiments will become apparent by reading the following detailed description with reference to the attached drawings, which illustrate the following.

DETAILED DESCRIPTION

Figure 1:
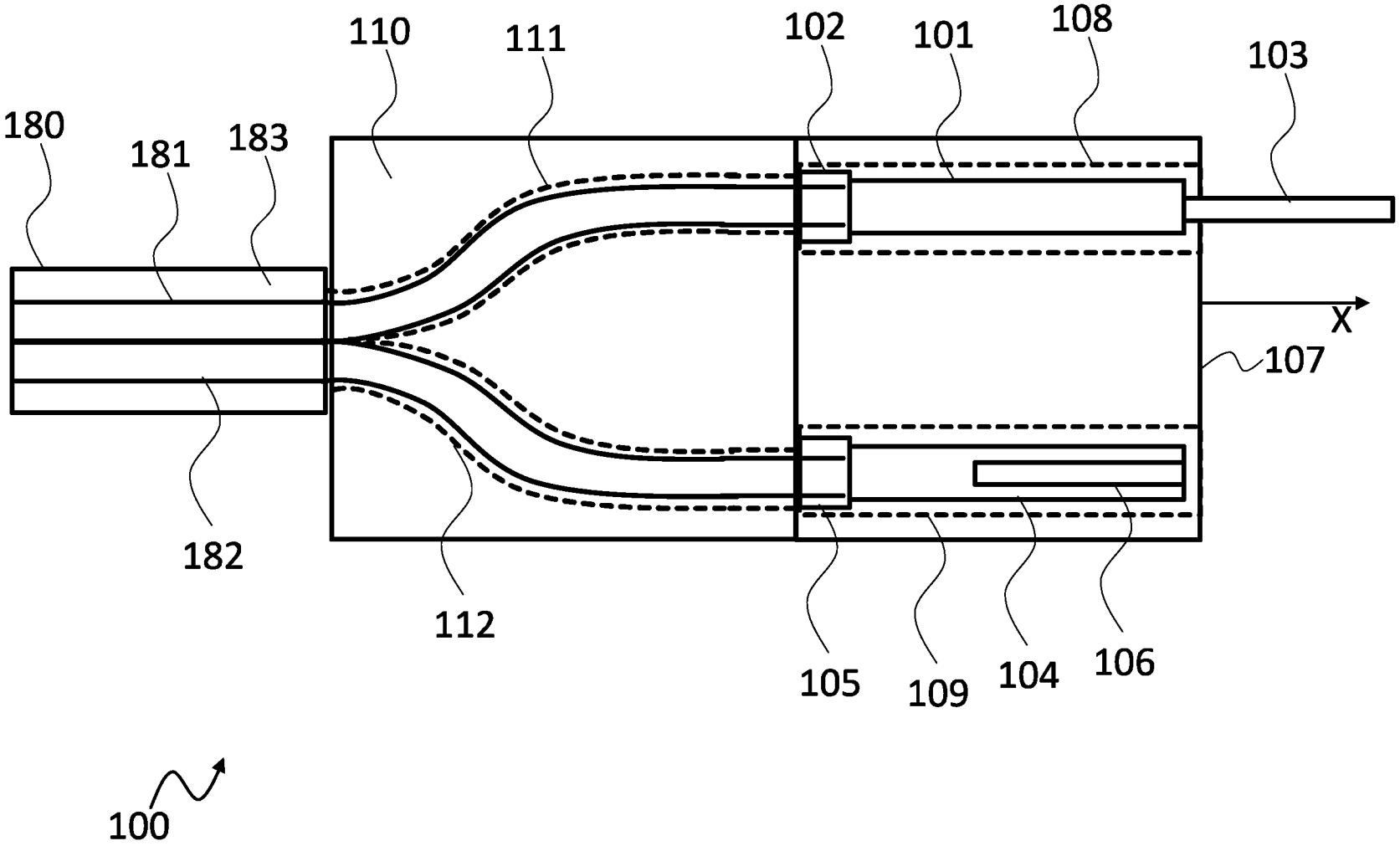
FIG. 1 shows a schematic representation of an embodiment of a plug-in connector according to the present invention.

In an embodiment, the present invention provides an optimized plug-in connector for high-frequency signal transmissions.

In an embodiment, the present invention provides a plug-in connector for a two-wire cable having a first wire and a second wire, which is arranged in the cable next to the first wire. The plug-in connector comprises a male contact, which can be coupled to the first wire, and is elongated at least in a plug-in direction of the plug-in connector, and a female contact, which can be coupled to the second wire, and is elongated at least in the plug-in direction of the plug-in connector, wherein the female contact is designed to receive a male contact of a further plug-in connector, and the male contact is designed to contact the female contact of the further plug-in connector. Furthermore, the plug-in connector comprises a carrier element which is designed to position and receive the male contact in a first receiving space and the female contact in a second receiving space, each at a predefined angle with respect to the plug-in direction of the plug-in connector, and to electrically insulate the male contact and the female contact from one another, and a shielding element, which includes a first channel for receiving the first wire and includes a second channel for receiving the second wire, wherein the first channel and the second channel each penetrate the shielding element from its end located counter to the plug-in direction to its end located in the plug-in direction, wherein the shielding element comprises an electrically conducting material, and wherein the shielding element is arranged at the end of the carrier element located counter to the plug-in direction.

In another embodiment, the present invention provides a method for assembling a cable with a plug-in connector according to the invention, wherein the cable comprises a first wire and a second wire. The method comprises the following steps: Coupling the first wire to a male contact, which is elongated at least in a plug-in direction of the plug-in connector, coupling the second wire to a female contact, which is elongated at least in the plug-in direction of the plug-in connector, wherein the female contact is designed to receive a male contact of a further plug-in connector, and the male contact is designed to contact the female contact of the further plug-in connector; introducing the male contact into a first receiving space of a carrier element; and introducing the female contact into a second receiving space of the carrier element, wherein the receiving spaces are each designed to position and receive the corresponding contact at a predefined angle with respect to the plug-in direction of the plug-in connector and to electrically insulate the male contact and the female contact from one another; and enclosing the first wire with a first channel of a shielding element and enclosing the second wire with a second channel of the shielding element, wherein the first channel and the second channel each penetrate the shielding element from its end located counter to the plug-in direction to its end located in the plug-in direction, wherein the shielding element comprises an electrically conducting material, and wherein the shielding element is arranged at the end of the carrier element located counter to the plug-in direction.

Embodiments of the present invention are based on the discovery that, during the transmission of high-frequency signals, interference points in the signal path negatively influence the quality of the signal transmission.

Differential cables, also referred to as twisted pair cables, are typically used for the transmission of high-frequency signals. In twisted pair cables, two differentially used wires are arranged twisted together in each case, whereby the susceptibility of the pair of wires to external interferences is minimized.

Interferences occur in the signal path to a greater extent in plug-in connectors, since transitions between the wires of a cable and the respective contact occur here, for example, and the guidance of the individual wires of a cable usually cannot be precisely defined. In particular, the twisting of a pair of wires must be undone in plug-in connectors, and the individual wires must be guided to the respective contact.

In order to reduce the susceptibility of signal paths to high-frequency signals, the present invention provides the plug-in connector. The plug-in connector is used to contact a cable comprising two adjacent wires. "Adjacent" wires shall be understood to mean that the sheaths of the individual wires can touch one another. It shall be understood that the two wires can be twisted together, that is to say the cable can be a twisted pair cable.

The plug-in connector comprises a male contact and a female contact. The contacts are both elongated in the plug-in direction of the plug-in connector and, in one embodiment, are designed symmetrically with respect to the longitudinal axis or a plane through the longitudinal axis. The plug-in direction of the plug-in connector can also be referred to as the main direction of extension of the plug-in connector, and the corresponding axis can be referred to as the main axis of extension of the plug-in connector.

The male contact is designed to contact the female contact of a further plug-in connector, according to the invention. The female contact is designed to receive the male contact of the further plug-in connector, according to the invention.

Two plug-in connectors according to the invention can consequently be coupled to one another. The plug-in connector can thus also be referred to as a hermaphroditic plug-in connector. In the case of a hermaphroditic plug-in connector, the so-called insert can be plugged into itself. In the plug-in region, the hermaphroditic plug-in connector comprises a pin component and a coupler component with the male and female contacts. By designing the plug-in connector as a hermaphroditic plug-in connector, only one embodiment of a mechanical interface, this being the insert, is necessary in order to be able to produce two plug-in connectors that can be coupled to one another.

The male and female contacts can be stamped and formed, for example, from a corresponding metal sheet. For fastening to the strand of a corresponding wire, the contacts at one end can each comprise a crimp tab. It shall be understood that other types of coupling between the contact and the wire are also possible.

At the end located opposite the crimp tab, the male contact comprises a contact pin. Such a male contact can also be referred to as a pin contact or as a contact in a pin design. The female contact includes a receiving space for the contact pin of a further male contact at the end opposite the crimp tab. Such a female contact can also be referred to as a socket contact or a contact in a socket design. Contact springs, which mechanically and electrically contact an inserted contact pin, can, for example, be arranged around the receiving space.

It shall be understood that the above explanations regarding the contacts are merely exemplary and that the plug-in connector of the present invention is not limited to such contacts, but can be used with any suitable type of contact.

In particular in the automotive field, strict requirements are placed on the high-frequency properties of a plug-in connector. There are only limited possibilities for optimizing a plug-in connector with regard to the high-frequency properties. In the plug-in connector according to the invention, the tolerance chains from the housing to the inner conductors or contacts are improved for this purpose.

The plug-in connector provides the carrier element for receiving and exactly positioning the contact. For each of the contacts, the carrier element has a receiving space into which the corresponding contact can be inserted. During assembly of the plug-in connector, the contacts can be pushed or placed into the receiving spaces, for example, and the carrier element encloses the contacts in the assembled state of the plug-in connector.

The contacts can be held in the carrier element, for example by the static friction between the material of the carrier element and the contacts. A retaining device can additionally be provided between the carrier element and the contacts, which retaining device prevents the contacts from sliding out of the receiving spaces. Such a retaining device can, for example, comprise detent elements and corresponding supports or recesses which establish a detent connection between the contacts and the carrier element.

The contacts are positioned with their longitudinal axis in the receiving spaces at a predefined angle, substantially parallel to the plug direction or main extension axis of the plug-in connector. The predefined angle can be an acute angle of less than 10°, in particular an angle between 0° and 5°, between 0° and 4°, between 0° and 3°, between 0° and 2°, or less than 1°.

The plug-in connector further provides a shielding element. The shielding element is used for electrical shielding of the wires of the cable in the region of the pitch widening. The region of the pitch widening denotes the region in the plug-in connector which is located between the carrier element and the end of the sheath of the cable. In this region, the distance, also referred to as pitch, between the wires of the cable increases. The wires located closely together in the cable are guided in the region of the pitch widening in such a way that they are spaced apart from one another at the same distance at the end of this region, similarly to the contacts in the carrier element.

The region of the pitch widening represents a discontinuity point or an interference point in the signal path formed with the cable and the plug-in connector. In particular, the wires of the cable are not guided twisted together in this region and are thus susceptible to external interfering influences.

The wires are guided through the shielding element of the plug-in connector in the region of the pitch widening on exactly defined paths in the first and second channels. The shielding element made of electrically conducting material simultaneously shields the wires from external interfering influences in this region. Such a shield is particularly relevant during the transmission of high-frequency signals in the frequency range of, for example, more than 1 GHz, in order to ensure high signal transmission quality.

The plug-in connector according to the invention consequently improves the continuity and uniform course of the resistance of a signal path for the transmission of high-frequency signals, wherein jumps in the resistance in the signal path are suppressed.

The plug-in connector can comprise further elements that were not explicitly mentioned above. For example, the plug-in connector can comprise an outer conductor, which accommodates the carrier element, the shielding element, and the end of the sheath of the cable. Such an outer conductor can, for example, also establish electrical contact between a braid of the cable and the shielding element and, for this purpose, can comprise or be made of a conducting or metallic material. Furthermore, for example, a sleeve, in particular a crimp sleeve, can be provided, which is placed over the end of the sheath of the cable and serves as a support sleeve for the braid placed around. The outer conductor can be arranged above such a sleeve and can be pressed or crimped with the sleeve in the region of overlap. Furthermore, the outer conductor can be attached to the cable sheath, for example by means of insert molding.

Further embodiments and refinements can be derived from the following description with reference to the figures.

In one embodiment, the plug-in connector can comprise a wedge, which tapers starting from the carrier element counter to the plug-in direction in an axis located at least orthogonal with respect to the plug-in direction and which is arranged between the first receiving space and the second receiving space at the end of the carrier element located counter to the plug-in direction.

The wedge is used to exactly position the individual wires of the cable, in particular during the assembly of the plug-in connector and when a plug connection to the plug-in connector is established or disconnected.

For this purpose, the wedge is designed so as to receive the two wires at its end located opposite the plug-in direction, where they rest against one another. Over its length in the plug-in direction, the wedge widens so that, at its end located in the plug-in direction, the wires are located at the intended distance from one another, that is to say at the same distance at which the first contact and the second contact are arranged with respect to one another in the carrier element.

In such an embodiment, the channels in the shielding element can be open with respect to one another so that no closed wall is present between the first channel and the second channel. Rather, the wedge can separate the first channel from the second channel at least in one section.

If the wires are located in the first and second channels, they are held in an exactly defined position by the wedge tapering counter to the plug-in direction, in particular even when a plug-in connection with the plug-in connector is being established or disconnected.

When connecting a plug-in connector to a cable, the wedge can be arranged between the wires, and the contacts can be inserted in the carrier element, after the contacts have been connected to the strands of the wires. The positions of the wires for applying the shielding element are exactly defined by the wedge. Pinching incorrectly positioned wires when applying the shielding element is consequently effectively avoided.

In a further embodiment, the wedge may comprise an electrically conducting material.

The wedge can, for example, include a metallization or be made of a metal. In the region of the pitch widening, the wires can no longer be guided twisted together. An electrically conducting wedge insulates the two wires from one another in this region and thus increases the signal quality, which can be negatively influenced at this high-frequency interference point without an electrically conducting wedge.

In one embodiment, the wedge can be formed integrally with the carrier element and can be arranged in a corresponding recess of the shielding element.

In one embodiment, the carrier element can be a one-piece molded part, in particular a one-piece plastic part, specifically a one-piece plastic injection-molded part. In particular in one embodiment in which the wedge is formed integrally with the carrier element, the production of the individual components of the plug-in connector can thus be simplified.

If the wedge is to be designed to be electrically conducting, a metallization of the wedge can be created, for example, by an immersion bath or another type of coating with a corresponding material.

Alternatively, the wedge can, for example, be stamped or otherwise formed as a metal part and, for example, can be inserted or pushed into the solid material of the carrier element.

In a further embodiment, the shielding element can comprise two half shells. The cutting plane which divides the shielding element into the two half shells can be located, for example, in the center point of the cross-section of the first channel in the longitudinal extension direction and in the center point of the cross-section of the second channel in the longitudinal extension direction.

If the first channel and the second channel are located in the longitudinal extension direction, that is to say in the plug-in direction of the plug-in connector, for example in a horizontal plane, the section plane divides the plug-in connector centrally in this horizontal plane. Each of the half shells thus comprises one of the halves of the region of the pitch widening.

If the shielding element is implemented with two half shells, it can be manufactured and mounted very easily. In particular, in the assembled state, the half shells can, for example, be latchingly engaged with one another by means of a detent mechanism. For this purpose, for example, one of the half shells can comprise corresponding studs comprising integrally molded catch lugs. The other of the two half shells can include corresponding recesses in which the studs can engage during assembly of the plug-in connector.

In a further embodiment, each of the half shells can comprise a stud and a corresponding recess. In such an embodiment, the same component can be used for each of the two half shells. In this embodiment, the channels are axially symmetric with respect to the center axis or the longitudinal axis of the shielding element. Furthermore, the studs and the recess are also arranged symmetrically to this axis. It is thus ensured that two embodiments of the half shells can be placed on top of one another, and the stud of one half shell engages in the recess of the other half shell in each case.

The connection of the two half shells can be designed to be permanent, that is to say non-detachable.

In a further embodiment, the wedge can be arranged on one of the half shells.

In this embodiment, the vertical axis of the wedge, which is orthogonal to the longitudinal axis of the wedge and thus to the plug-in direction of the plug-in connector, extends from one of the half shells to the second half shell.

The wedge can have a taper over its entire length at its upper end, that is to say the end lying furthest away from the half shell. This facilitates insertion of the wedge between the wires when the two half shells are being joined. When the half shells are being joined, the wires slide along the wall of the wedge and are guided into the desired positions in the channels.

In one embodiment, the height of the wedge can be selected such that the wedge extends beyond the wires in a side view when the two wires are placed into the half shell. A corresponding receiving space for the protruding end of the wedge can be provided In the second half shell. The receiving space can in particular be shaped in keeping with the taper and receive the taper. In this embodiment, when the half shells are assembled, the wires rest against the region of the wedge which has no taper, and a clearance between the wedge and the wires is effectively prevented.

In order to still be able to work with two identical half shells, both half shells can include the receiving space in one embodiment. In such an embodiment, the wedge can be provided as a separate component and can include a corresponding taper both at its upper end and at its lower end. During the assembly of the plug-in connector, the wedge can be placed into one of the half shells and then the second half shell can be placed on top.

If the wedge is not formed on the carrier element, but designed as a separate component or on one of the half shells, the wedge can be produced from the same material as the shielding element. The additional step of metallizing the wedge in the carrier element is dispensed with.

In yet another embodiment, the plug-in connector can comprise a tubular metallic element, which has an opening surface and is arranged on the carrier element and surrounds at least the end of the male contact located in the plug-in direction.

The tubular metallic element can, for example, also be referred to as a sleeve and can include a metallization or be made of a metal. In the assembled end position, the sleeve surrounds the male contact and is thus used for electromagnetically shielding the male contact, in particular in the frequency range of more than 1 (one) GHz. At the same time, the sleeve forms a mechanical protection for the male contact.

The opening surface of the tubular metallic element can be selected such that the outer contour of the female contact fits into the tubular metallic element. The female contact can consequently be plugged into the metallic element and thereby receive the contact pin of the male contact.

The metallic element can be coupled with further elements of the plug-in connector. For example, the metallic element can be electrically coupled with an outer conductor of the plug-in connector. As already explained above, such an outer conductor can also be electrically coupled to a braid of the cable. This ensures continuous shielding of the cable and of the plug-in connector.

The metallic element can be made, for example, of spring steel as a stamped and bent part. The connection between the metallic element and such an outer conductor can be designed, for example, as a crimp connection, as a solder connection, as a welded connection or the like.

In yet another embodiment, the first channel and the second channel can transition into one another at the end of the shielding element, which is located counter to the plug-in direction, and can form a shared input channel for the first wire and the second wire.

A shared input channel allows the wires to be received exactly in the position in which the wires are also located next to one another in the cable. The widening of the distance between the wires can be exactly controlled by the channels.

FIG. 1 shows a schematic representation of an embodiment of a plug-in connector 100 according to the invention. The plug-in connector 100 is used for coupling to a two-wire cable 180 comprising a first wire 181 and a second wire 182. The cable 180 is a two-wire data cable for the differential transmission of data and can, for example, be a twisted pair cable. The data cable is in particular designed to be shielded.

The plug-in connector 100 comprises a male contact 101, a female contact 104, a carrier element 107, and a shielding element 110.

The male contact 101 and the female contact 104 are elongated in the plug-in direction X of the plug-in connector 100.

The male contact 101 comprises a coupling section 102 at its end located counter to the plug-in direction X, and a contact pin 103 at its other end. The female contact 104 also comprises a coupling section 103 at its end located counter to the plug-in direction X. At its opposite end, the female contact 104 has a contact space 105. The contact space 105 is designed so as to be able to receive and electrically contact the contact pin 103 of the male contact 101. This makes it possible to plug the plug-in connector 100 into a further plug-in connector 100, rotated 180° about its longitudinal axis.

The coupling sections 102, 105 are each used for the electrical and mechanical connection of a strand of the corresponding wire 181, 182 of the cable 180. For this purpose, the coupling sections 102, 105 can be designed, for example, as crimp tabs, which can be crimped together with the strands.

The carrier element 107 is used to position and fix the male contact 101 and the female contact 104. For this purpose, the male contact 101 and the female contact 104 are located in the carrier element 107 in corresponding receiving spaces 108, 109, which establish the position for the male contact 101 and the female contact 104. The receiving spaces pass through the carrier element 107 in the plug-in direction X of the plug-in connector 100. The contacts 101, 104 are therefore located parallel to the plug-in direction X of the plug-in connector 100. The carrier element 107 is designed as an electrical insulator between the male contact 101 and the female contact 104. For this purpose, the carrier element 107 can be designed, for example, as a plastic part.

The shielding element 110 adjoins the carrier element 107 counter to the plug-in direction X of the plug-in connector 100 and is located between the carrier element 107 and the end of the sheath 183 of the cable 180.

The shielding element 110 guides the individual wires 181, 182 of the cable 180 to the carrier element 107 in a first channel 111 and a second channel 112. In contrast to the carrier element 107, the shielding element 110 comprises an electrically conducting material and insulates the wires 181, 182 from external interfering influences between the end of the sheath 183 of the cable 180 and the carrier element 107, that is to say the connection of the wires 181, 182 to the contacts 101, 104.

The channels 111, 112 are shaped in such a way that the wires 181, 182, which are located together at the end of the sheath 183, are widened, that is to say guided apart, so that their distance at the end of the shielding element 110 which is located in the plug-in direction X corresponds to the distance of the contacts 101, 104. The shielding element 110 thus shields the wires 181, 182 at a sensitive high-frequency interference point and thus increases the quality of the data transmission by way of the plug-in connector 100.

Figure 2:
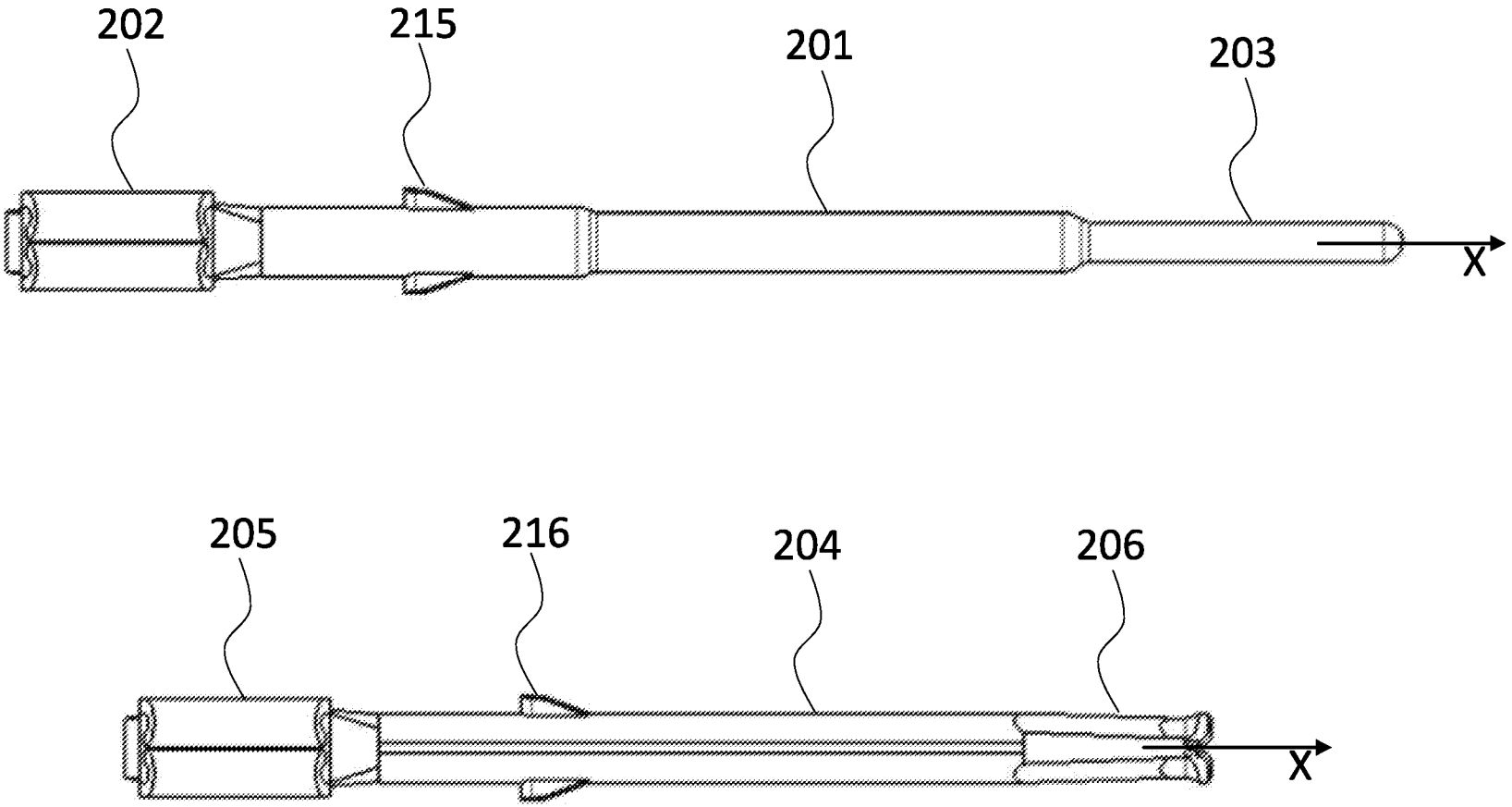
FIG. 2 shows a plan view of an embodiment of a male contact and a female contact according to the present invention.

FIG. 2 shows a top view of an embodiment of a male contact 201 and an exemplary embodiment of a female contact 204 according to the present invention.

The two contacts 201, 204 have an elongated shape. At one end, the two contacts 201, 204 each include a coupling section 202, 205 which is used to connect the respective contact 201, 204 to the respective wire of a cable. As was already explained above, the coupling section 202, 205 can, for example, each comprise a crimp tab. It shall be understood that other options for the connection between the coupling section 202, 205 and the wire are also possible. For example, the wires can be soldered or welded to the respective coupling section 202, 205.

Catch lugs 215, 216 are arranged on the bodies of the elongated contacts at approximately one third of the length starting from the end of the respective coupling section 202, 205. The catch lugs 215, 216 are used to fix the respective contact 201, 204 in the carrier element, see also FIGS. 3 and 8 in this regard.

At its end located in the plug-in direction X, the male contact 201 comprises a contact pin 203. The female contact 204 includes a contact space 206 at this end. In the case of the female contact 204, the contact space 206 comprises contact springs which are inclined into the interior of the contact space 206. When a contact pin 203 is now inserted into the contact space 206, it presses the contact springs to the outside, and the resulting pressing force ensures the electrical contact.

Figure 3:
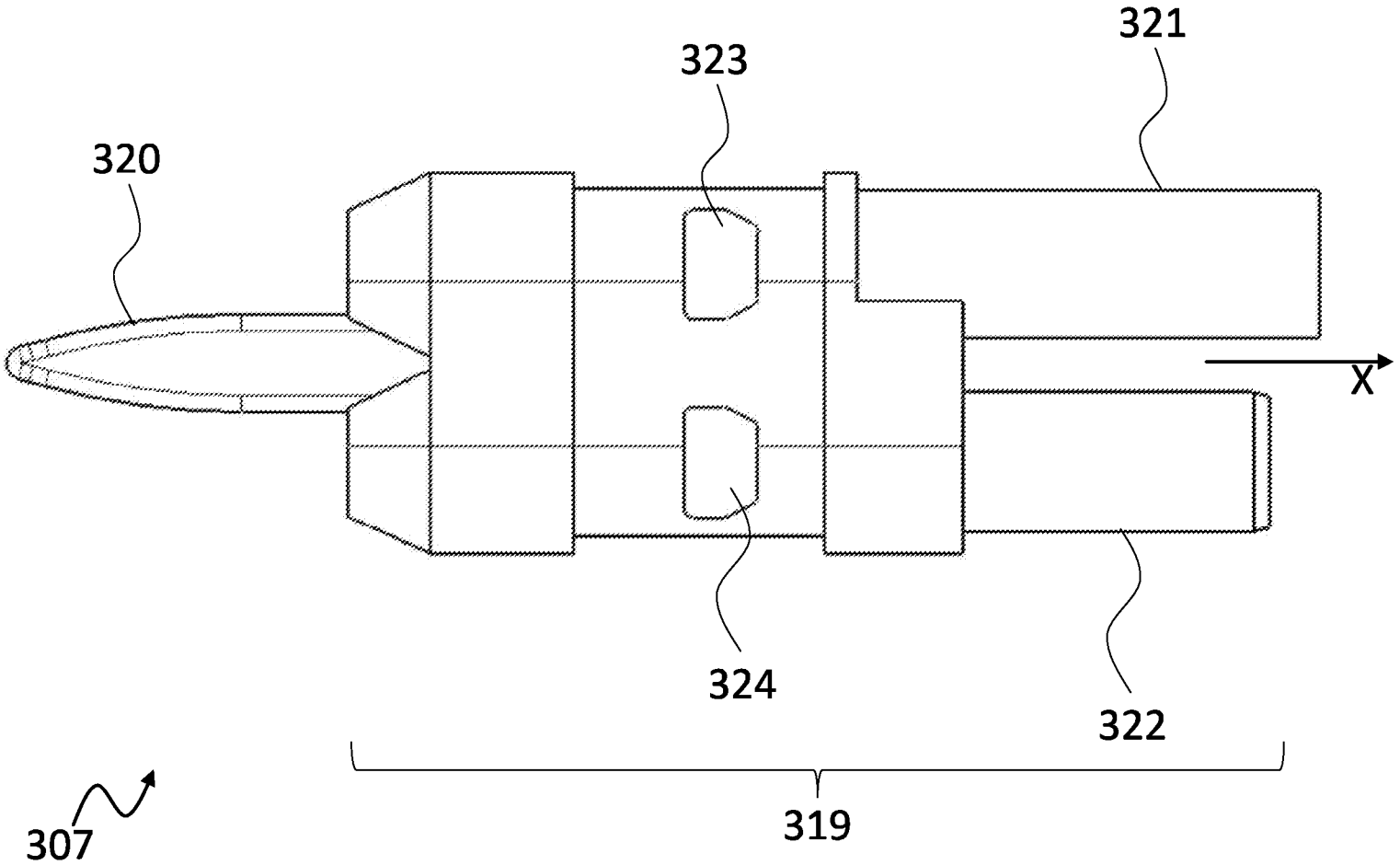
FIG. 3 shows a plan view of an embodiment of a carrier element according to the present invention.

FIG. 3 shows a plan view of an embodiment of a carrier element 307.

The carrier element 307 comprises a base body 319 which corresponds to the carrier element 107 in FIG. 1. At its end located in the plug-in direction X, the base body 319 comprises a guide element 321, 322, for each of the contacts, in which the respective contact is in its end position. Furthermore, for each of the contacts, the base body 319 has a recess 323, 324 in which, for example, a catch lug of the respective contact engages (see FIG. 2) in order to fix the contact in the carrier element 307.

A wedge 320, which tapers counter to the plug-in direction X, extends from the base body 319 counter to the plug-in direction X of the connector. The wedge 320 is used to spread out the wires of the cable in an exactly defined path. When the wedge 320 is pushed between the wires as the contacts connected to the wires are being introduced into the base body, the wires are pushed apart by the wedge and brought into the desired position. As a result of the wedge, it is consequently possible to specify the exact position of the wires, in particular in the assembled plug-in connector.

Since the shielding element surrounds the wires and the wedge when the plug-in connector is assembled, the wires cannot change their positions even when the plug-in connector is inserted or a plug-in connection is detached.

Figure 4:
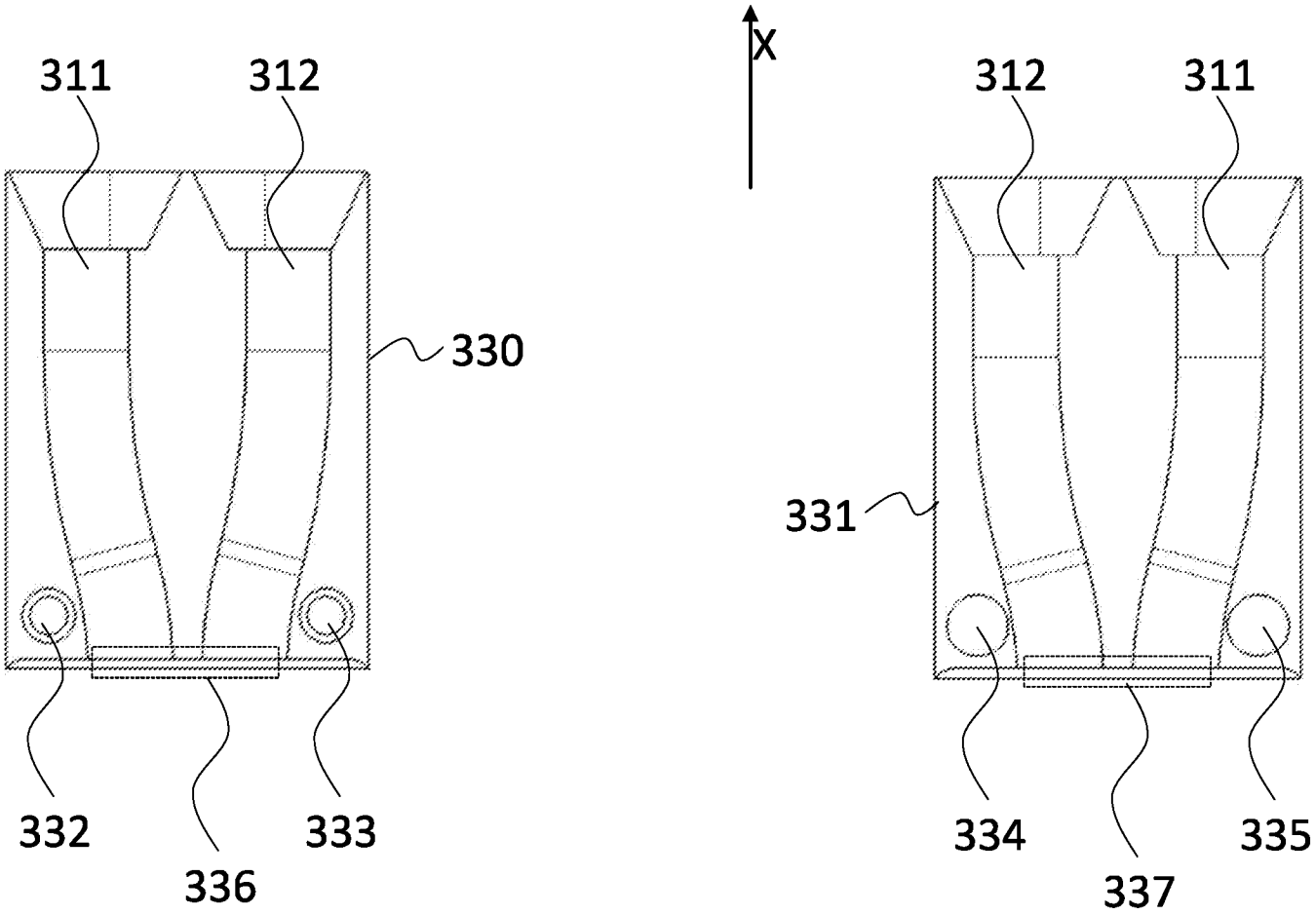
FIG. 4 shows a plan view of an embodiment of two half shells according to the present invention.

FIG. 4 shows a plan view of an embodiment of two half shells 330, 331 of a shielding element.

The two half shells 330, 331 are designed to be approximately identical. The difference between the half shells 330, 331 is only that the half shell 330 comprises studs 332, 333, and the half shell 331 comprises recesses 334, 335 for the studs 332, 333. The two half shells 330, 331 can consequently be joined, wherein the studs 332, 333 engage in the recesses 334, 335. The following explanations regarding half shell 330 therefore also apply analogously to half shell 331.

The half shell 330 comprises two channels 311, 312 for receiving the wires of the cable. At the end located counter to the plug-in direction X, the two channels form a shared input channel 336. Via the input channel 336, the wires can be received in the shielding element, resting against one another.

Starting from the input channel 336, the distance between the channels 311, 312 widens so that the two wires in the channels are guided away from one another in the insertion direction X. It shall be understood that, in one embodiment of the plug-in connector with a wedge, see, for example, FIGS. 3 and 8, the contour of the half shell 336 between the two channels 311, 312 can correspond to the contour of the wedge.

It shall be understood that, in one embodiment, the half shells 330, 331 can be designed to be identical. In such an embodiment, each of the half shells 330, 331 comprises a stud 332, 333 and a recess 334, 335 so that the half shells 330, 331 can be joined.

Figure 5:
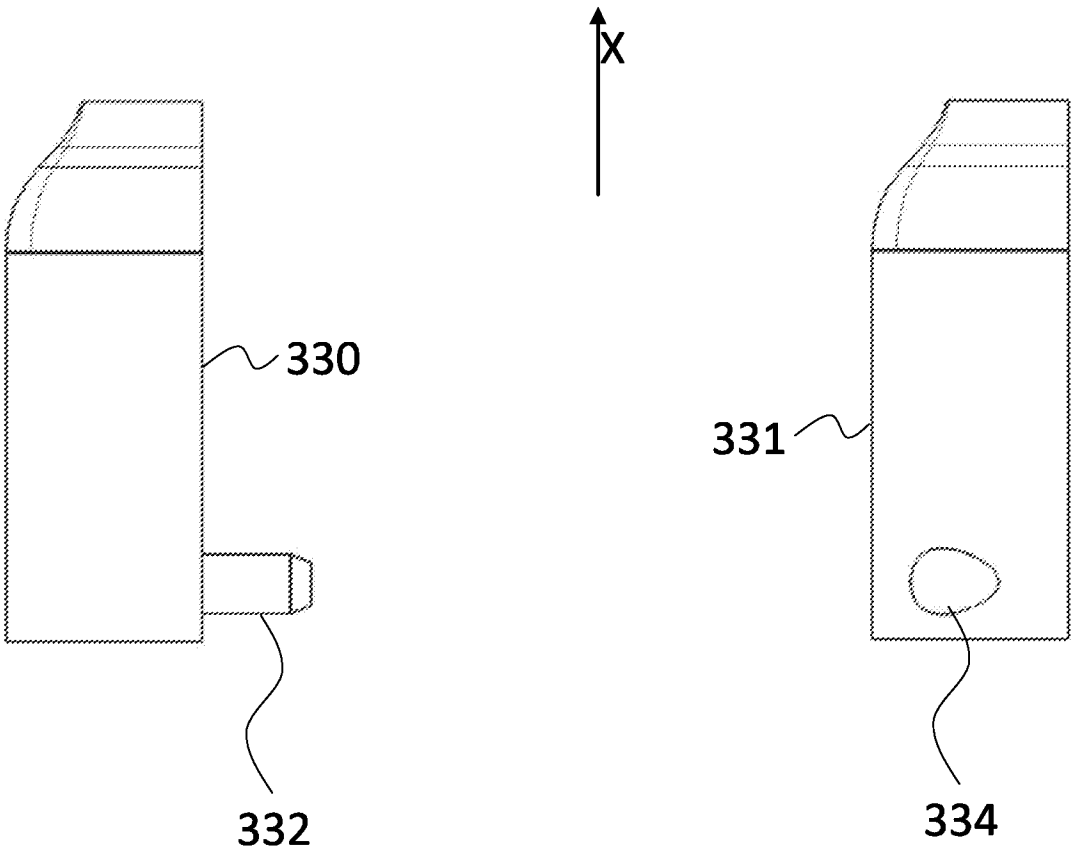
FIG. 5 shows a side view of the half shells of FIG. 4.

FIG. 5 shows a side view of the half shells 330, 331 of FIG. 4.

It is apparent that the recesses 334, 335 penetrate the half shell 331. When the studs 332, 333 are inserted into the recesses 334, 335 as the half shells 330, 331 are being joined, they can likewise protrude beyond the material of the half shell 331.

This protrusion can be used, for example, to securely connect the half shells 330, 331 to one another. The studs 332, 333 can, for example, comprise corresponding detent elements. Alternatively, the protrusion of the studs 332, 333 can also be pressed or welded.

Figure 6:
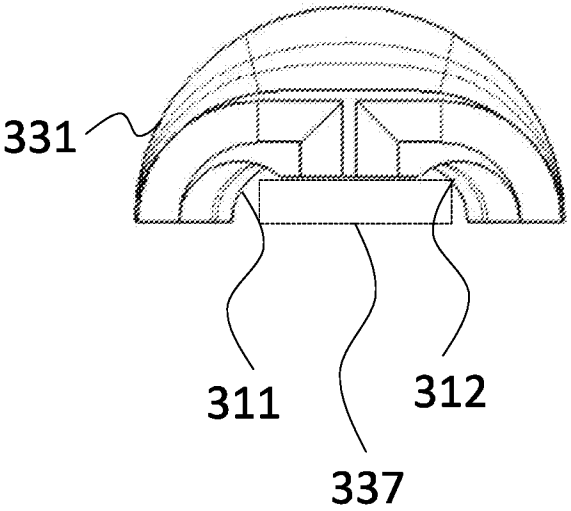
FIG. 6 shows a front view of the half shells of FIG. 4.
Figure 6:
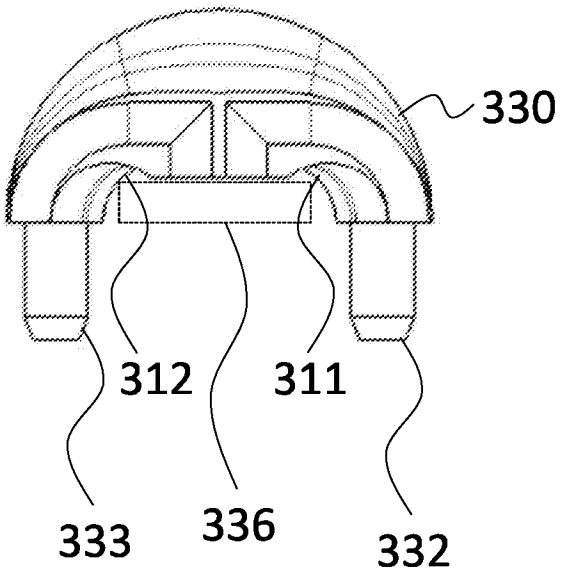

FIG. 6 shows a front view of the half shells 330, 331 of FIG. 4.

The half shells 330, 331 have no material between the channels 312, 311, or the material between the channels 312, 311 does not reach the contact surface between the two half shells 330, 331. The half shells 330, 331 thus form a space for the wedge. In one embodiment without wedge, the material of the half shells 330, 331 can of course extend to the contact surface between the two half shells 330, 331.

Figure 7:
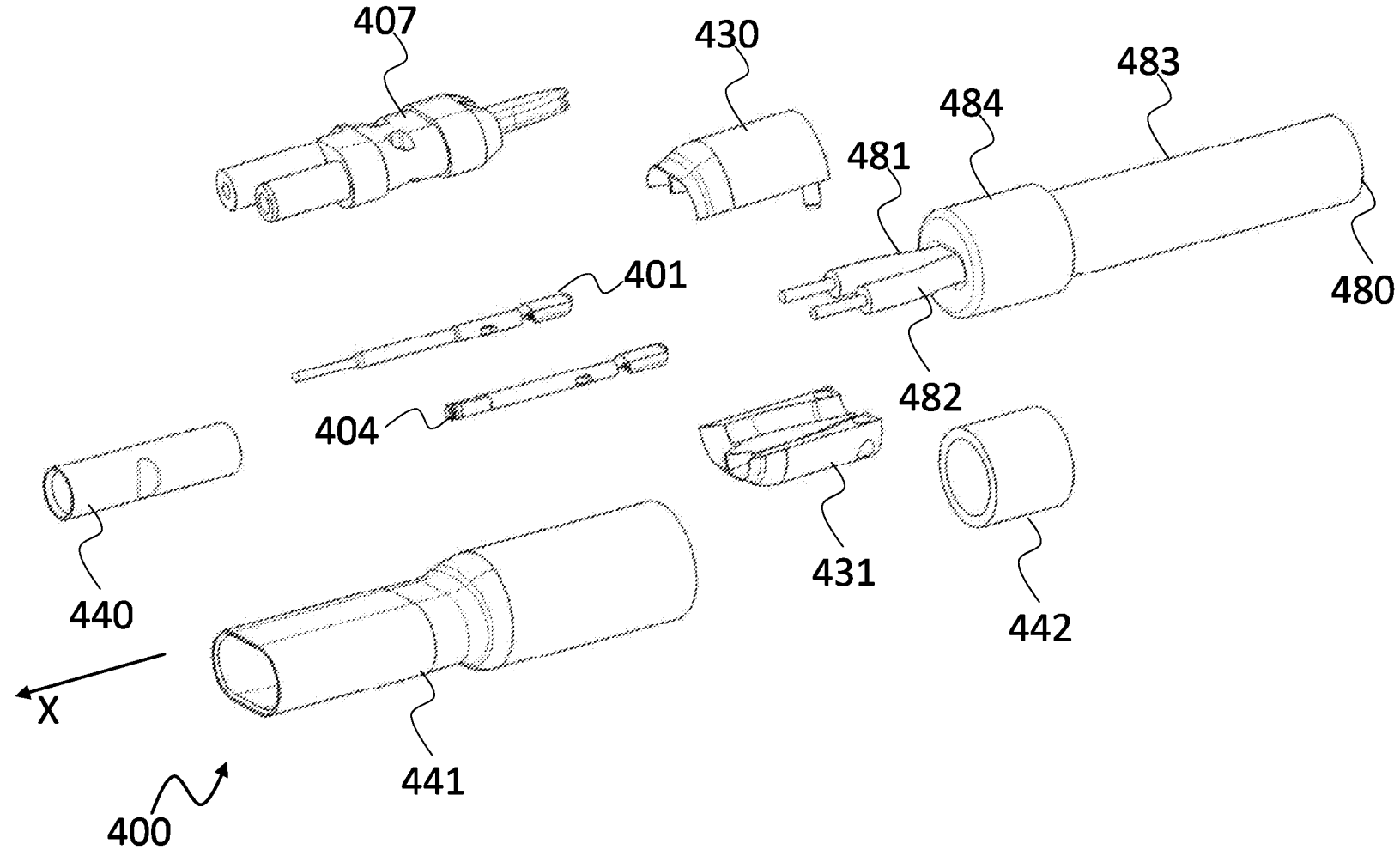
FIG. 7 shows an exploded view of an embodiment of a plug-in connector according to the present invention.

FIG. 7 shows an exploded view of an embodiment of a plug-in connector 400 for a cable 480 comprising two wires 481, 482 and a braid 484 in a sheath 483.

The plug-in connector 400 comprises a carrier element 407 which receives a male contact 401 and a female contact 404. The male contact 401 can, for example, be coupled to the wire 481, and the female contact 404 can be coupled to the wire 482. Between the carrier element 407 and the end of the sheath 483 of the cable 480, the plug-in connector 400 comprises the shielding element in the form of the two half shells 430, 431.

In addition to the aforementioned elements, the plug-in connector 400 comprises a sleeve 442, which is placed as a support sleeve between the sheath 483 and the folded-over braid 484.

Furthermore, the plug-in connector 400 comprises a metal tube 440, which is pushed over the male contact 401. Furthermore, an outer conductor 441 is arranged over the entire structure. The metal tube 440 is used to mechanically protect the contact pin of the male contact 401. In a further embodiment, the tube can also be made of a non-metallic material for mechanical protection. In the plug-in connector 400, the metal tube is electrically connected to the likewise conducting outer conductor 441. The outer conductor 441 is furthermore electrically connected to the braid 484 and the shielding element 430, 431. In this way, continuous shielding from the end of the cable 480 to the end of the contact pin of the male contact 401 is ensured.

Figure 8:
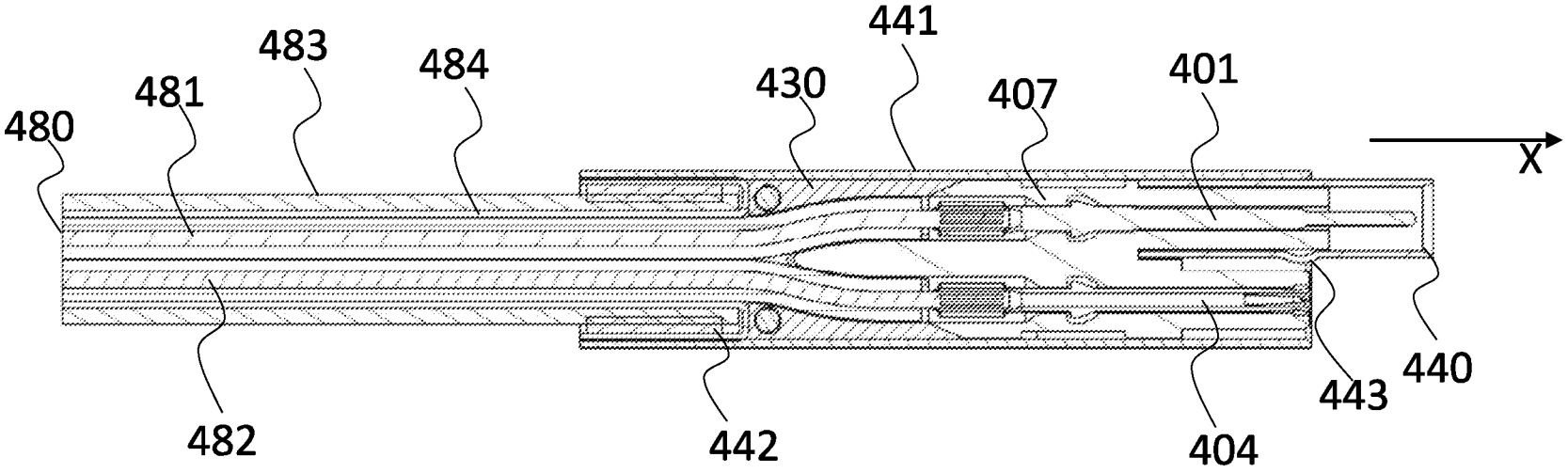
FIG. 8 shows a sectional view of the embodiment of the plug-in connector of FIG. 7.

FIG. 8 shows a sectional view of the embodiment of the plug-in connector of FIG. 7, wherein the section plane is located on the longitudinal axes of the two contacts 401, 404.

In the sectional view, it is apparent that the sleeve 442 rests on the sheath of the cable 480, and the braid 484 has been placed over the sleeve. The outer conductor 441 can be pressed or crimped, for example, to the support sleeve and thus the cable 480.

The sectional view also shows that the catch lugs of the contacts 401, 404 are located in the receptacles of the carrier element 407 provided for this purpose. This effectively prevents the contacts 401, 404 from sliding out of the carrier element when a plug-in connection is being established.

Finally, on its outside, the metal tube 440 has an elevation 443 in the direction of female contact. If a further plug-in connector is now plugged into the plug-in connector 400, the metal tube of the further plug-in connector moves over the female contact 404 of the plug-in connector 400. The elevation 443 is then pressed against this metal tube, thereby establishing an electrical connection of the shields of the two plug-in connectors.

Figure 9:
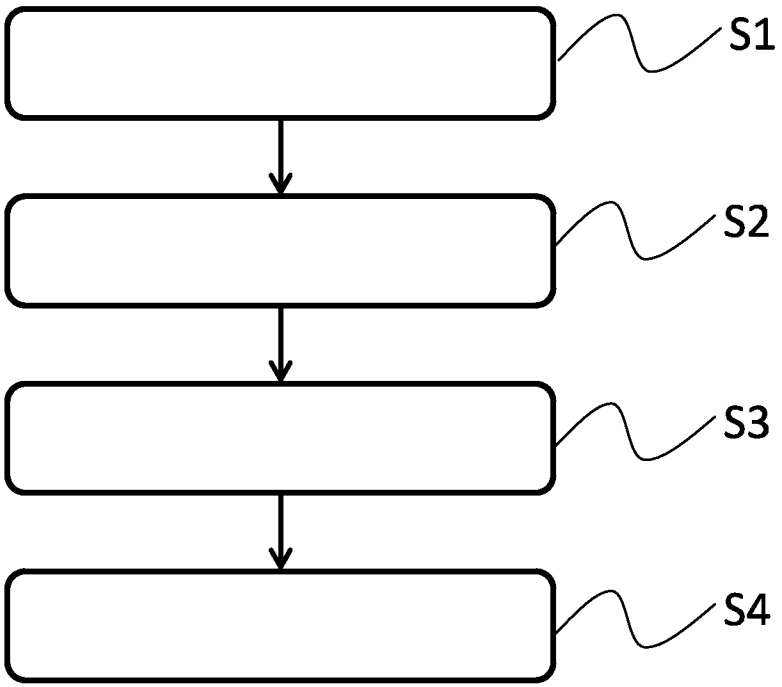
FIG. 9 shows a flow chart of an embodiment of a method according to the present invention.

FIG. 9 shows a flow chart of an embodiment of a method for assembling a cable 180, 480 with a plug-in connector 100, 400 according to the invention, wherein the cable 180, 480 comprises a first wire 181, 481 and a second wire 182, 482.

The method comprises the following steps:

Coupling S1 the first wire 181, 481 to a male contact 101, 201, 401, which is elongated at least in a plug-in direction X of the plug-in connector 100, 400; and coupling S2 of the second wire 182, 482 to a female contact 104, 204, 404, which is elongated at least in the plug-in direction X of the plug-in connector 100, 400. Since the plug-in connector 100, 400 is designed as a hermaphroditic connector, the female contact 104, 204, 404 is designed to receive a male contact 101, 201, 401 of a further plug-in connector 100, 400. The male contact 101, 201, 401 is designed to contact the female contact 104, 204, 404 of the further connector 100, 400.

The method furthermore comprises introducing S3 the male contact 101, 201, 401 into a first receiving space 108 of a carrier element 107, 307, 407, and introducing the female contact 104, 204, 404 into a second receiving space 109 of the carrier element 107, 307, 407. The receiving spaces are each designed to position and receive the corresponding contact at a predefined angle with respect to the plug-in direction X of the plug-in connector 100, 400 and to electrically insulate the male contact 101, 201, 401 and the female contact 104, 204, 404 from one another.

Finally, the method comprises enclosing S4 the first wire 181, 481 with a first channel 111, 311 of a shielding element 110, and enclosing the second wire 182, 482 with a second channel 112, 312 of the shielding element 110. The first channel 111, 311 and the second channel 112, 312 each penetrate the shielding element 110 from its end located counter to the plug-in direction X to its end located in the plug-in direction X. The shielding element 110 comprises an electrically conducting material and is arranged at the end of the carrier element 107, 307, 407 located counter to the plug-in direction X. The first wire 181, 481 and the second wire 182, 482 can be guided into the first channel 111, 311 and the second channel 112, 312 via a shared input channel 336, 337.

The enclosing can comprise placing two half shells 330, 331, 430, 431 of the shielding element 110 from two opposing directions onto the first wire 181, 481 and the second wire 182, 482, and coupling the two half shells 330, 331, 430, 431 to one another.

In order to protect and shield the male contact 101, 201, 401, a tubular metallic element 440 can be attached to the carrier element 107, 307, 407 above the end of the male contact 101, 201, 401 located in the plug-in direction X.

In order to permanently fix the position of the individual wires 181, 481, 182, 482 of the cable 180, 480, a wedge 320, in particular a wedge 320 comprising an electrically conducting material, is positioned or inserted between the first wire 181, 481 and the second wire 182, 482 in one embodiment. Starting from the carrier element 107, 307, 407, the wedge 320 tapers counter to the plug-in direction X in an axis located at least orthogonal to the plug-in direction X and is arranged at the end of the carrier element 107, 307, 407 located counter to the plug-in direction X between the first receiving space 108 and the second receiving space 109.

The wedge 320 can be designed integrally with the carrier element 107, 307, 407 and can be arranged in a corresponding recess of the shielding element 110.

Alternatively, the wedge 320 can be arranged on one of the half shells 330, 331, 430, 431.

Since the devices and methods described in detail above are exemplary embodiments, they can be modified on a broad scale in the usual manner by a person skilled in the art without departing from the scope of the invention. In particular, the mechanical arrangements and the proportions of the individual elements with respect to one another are merely exemplary.

While subject matter of the present disclosure has been illustrated and described in detail in the drawings and foregoing description, such illustration and description are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SYMBOLS

100, 400 Plug-in connector
101, 201, 401 Male contact
102, 202, Coupling section
103, 203 Contact pin
104, 204, 404 Female contact
105, 205 Coupling section
106, 206 Contact space
107, 307, 407 Carrier element
108 First receiving space
109 Second receiving space
110 Shielding element
111, 311 First channel
112, 312 Second channel
215, 216 Catch lugs
319 Base body
320 Wedge
321, 322 Guide element
323, 324 Recess
330, 331, 430, 431 Half shell
332, 333 Stud
334, 335 Recess
336, 337 Input channel
440 Metallic element
441 Outer conductor
442 Sleeve
443 Elevation
180, 480 Cable
181, 481 First wire
182, 482 Second wire
183 Sheath
484 Braid
X Plug-in direction
S1, S2, S3, S4 Method steps

The invention claimed is:

1. A plug-in connector for a two-wire or multi-wire cable comprising at least one wire pair for a differential data transmission, comprising a first wire and a second wire which is arranged in the cable next to the first wire, the plug-in connector comprising:

a male contact which is configured to be coupled to the first wire and is elongated at least in a plug-in direction of the plug-in connector;

a female contact which is configured to be be coupled to the second wire and is elongated at least in the plug-in direction of the plug-in connector, wherein the female contact is configured to receive a male contact of a further plug-in connector, and wherein the male contact is configured to receive a female contact of the further connector;

a carrier element which is configured to position and receive the male contact in a first receiving space and the female contact in a second receiving space, each at a predefined angle with respect to the plug-in direction of the plug-in connector, and to electrically insulate the male contact and the female contact from one another wherein the male contact extends from the carrier element; and a shielding element which includes a first channel for receiving the first wire and a second channel for receiving the second wire, wherein the first channel and the second channel each penetrate the shielding element from an end of the shielding element located counter to the plug-in direction to an end of the shielding element located in the plug-in direction, wherein the shielding element comprises an electrically conducting material, and wherein the shielding element is arranged at an end of the carrier element located counter to the plug-in direction.

2. The plug-in connector according to claim 1, further comprising a wedge which, starting from the carrier element, tapers counter to the plug-in direction in an axis located at least orthogonal to the plug-in direction and is arranged at the end of the carrier element located counter to the plug-in direction between the first receiving space and the second receiving space.

3. The plug-in connector according to claim 2, wherein the wedge comprises an electrically conducting material.

4. The plug-in connector according to claim 2, wherein the wedge is designed integrally with the carrier element, and wherein the wedge is arranged in a corresponding recess of the shielding element.

5. The plug-in connector according to claim 1, wherein the shielding element comprises two half shells.

6. The plug-in connector according to claim 5, wherein a section plane which divides the shielding element into the two half shells is located in the center point of the cross-section of the first channel in the longitudinal extension direction and in the center point of the cross-section of the second channel in the longitudinal extension direction.

7. The plug-in connector according to claim 5, further comprising a wedge which, starting from the carrier element, tapers counter to the plug-in direction in an axis located at least orthogonal to the plug-in direction and is arranged at the end of the carrier element located counter to the plug-in direction between the first receiving space and the second receiving space, wherein the wedge is arranged on one of the half shells.

8. The plug-in connector according to claim 1, further comprising a tubular metallic element which has a predefined opening surface and is arranged on the carrier element, the tubular metallic element surrounding at least an end of the male contact located in the plug-in direction.

9. The plug-in connector according to claim 1, wherein the first channel and the second channel transition into one another at the end of the shielding element which is located counter the plug-in direction and form a shared input channel for the first wire and the second wire.

10. The plug-in connector according to claim 1, wherein the carrier element includes, at an end located in the plug-in direction, a first guide element for the male contact and a second guide element for the female contact.

11. The plug-in connector according to claim 10, wherein the first and second guide elements are different from each other.

12. The plug-in connector according to claim 11, wherein the first and second guide elements have different extents in the plug-in direction.

13. A method for assembling a cable with a plug-in connector, wherein the cable comprises a first wire and a second wire, the method comprising:

coupling the first wire to a male contact which is elongated at least in a plug-in direction of the plug-in connector;

coupling the second wire to a female contact which is elongated at least in the plug-in direction of the plug-in connector, wherein the female contact is configured to receive a male contact of a further plug-in connector, and wherein the male contact is configured to receive a female contact of the further plug-in connector;

introducing the male contact into a first receiving space of a carrier element, and introducing the female contact into a second receiving space of the carrier element, wherein the receiving spaces are each configured to position and receive the corresponding contact at a predefined angle with respect to the plug-in direction of the plug-in connector and to electrically insulate the male contact and the female contact from one another wherein the male contact extends from the carrier element, and enclosing the first wire with a first channel of a shielding element, and enclosing the second wire with a second channel of the shielding element, wherein the first channel and the second channel each penetrate the shielding element from an end of the shielding element located counter to the plug-in direction to an end of the shielding element located in the plug-in direction, wherein the shielding element comprises an electrically conducting material, and wherein the shielding element is arranged at an end of the carrier element located counter to the plug-in direction.

14. The method according to claim 13, further comprising inserting a wedge, which comprises an electrically conducting material, between the first wire and the second wire, wherein the wedge, starting from the carrier element, tapers counter to the plug-in direction in an axis located at least orthogonal to the plug-in direction and is arranged at the end of the carrier element located counter to the plug-in direction between the first receiving space and the second receiving space.

15. The method according to claim 13, wherein the wedge is designed integrally with the carrier element, and wherein the wedge is arranged in a corresponding recess of the shielding element.

16. The method according to claim 13, wherein the enclosing comprises placing two half shells of the shielding element from two opposing directions onto the first wire and the second wire, and coupling the two half shells to one another.

17. The method according to claim 14, further comprising inserting a wedge, which comprises an electrically conducting material, between the first wire and the second wire, wherein the wedge, starting from the carrier element, tapers counter to the plug-in direction in an axis located at least orthogonal to the plug-in direction and is arranged at the end of the carrier element located counter to the plug-in direction between the first receiving space and the second receiving space, and wherein the wedge is arranged on one of the half shells.

18. The method according to claim 13, further comprising attaching a tubular metallic element, which has a predefined opening surface, to the carrier element above an end of the male contact located in the plug-in direction.

19. The method according to claim 13, wherein the first wire and the second wire are guided via a shared input channel into the first channel and the second channel, and wherein the shared input channel is arranged at the end of the shielding element located counter to the plug-in direction.

* * * * *